US006319020B1

(12) United States Patent
Brimhall et al.

(10) Patent No.: US 6,319,020 B1
(45) Date of Patent: Nov. 20, 2001

(54) PROGRAMMING CONNECTOR FOR HEARING DEVICES

(75) Inventors: Owen D. Brimhall, South Jordan; Carl E. Ellis, Salt Lake City; Craig M. Collotzi, Sandy, all of UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

(21) Appl. No.: 09/467,542

(22) Filed: Dec. 10, 1999

(51) Int. Cl.[7] ..... H01R 12/00
(52) U.S. Cl. ..... 439/77; 439/700; 381/69.2
(58) Field of Search ..... 439/67, 77, 700, 439/825, 840, 289

(56) References Cited

U.S. PATENT DOCUMENTS

| | | | | |
|---|---|---|---|---|
| 3,431,428 | * | 3/1969 | Van Valer . | |
| 3,665,122 | | 5/1972 | Weiss | 179/107 BC |
| 4,186,983 | * | 2/1980 | Kaye | 429/97 |
| 4,375,016 | | 2/1983 | Harada | 179/182 R |
| 4,553,627 | | 11/1985 | Gastmeier et al. | 181/135 |
| 4,569,812 | | 2/1986 | Werwath et al. | 264/222 |
| 4,756,312 | | 7/1988 | Epley | 128/420.5 |
| 4,879,750 | | 11/1989 | Nassler | 381/68.6 |
| 4,880,076 | | 11/1989 | Ahlberg et al. | 181/130 |
| 4,937,876 | | 6/1990 | Biërmans | 381/68.6 |
| 4,961,230 | * | 10/1990 | Rising | 381/69.2 |
| 5,002,151 | | 3/1991 | Oliveira et al. | 181/130 |
| 5,031,219 | | 7/1991 | Ward et al. | 381/68.6 |
| 5,084,224 | | 1/1992 | Watters | 264/155 |
| 5,099,947 | | 3/1992 | Guggenberger et al. | 181/130 |
| 5,105,904 | | 4/1992 | Olsen | 181/128 |
| 5,166,659 | | 11/1992 | Navarro | 381/68.6 |
| 5,188,540 | * | 2/1993 | Haertl | 439/500 |
| 5,201,007 | | 4/1993 | Ward et al. | 381/68.6 |
| 5,203,352 | | 4/1993 | Gardner, Jr. | 128/864 |
| 5,293,008 | | 3/1994 | Danielsen | 181/135 |
| 5,327,500 | | 7/1994 | Campbell | 381/68.6 |
| 5,395,168 | | 3/1995 | Leenen | 381/68.6 |
| 5,401,920 | | 3/1995 | Oliveira | 181/135 |
| 5,440,082 | | 8/1995 | Claes | 181/135 |
| 5,447,442 | * | 9/1995 | Swart | 439/77 |
| 5,502,769 | * | 3/1996 | Gilbertson | 381/68 |
| 5,682,020 | | 10/1997 | Oliveira | 181/130 |
| 5,701,348 | | 12/1997 | Shennib et al. | 381/68.6 |
| 5,881,159 | | 3/1999 | Aceti et al. | 381/328 |
| 5,920,636 | | 7/1999 | Oliveira et al. | 381/328 |
| 5,996,584 | | 12/1999 | Oliviera et al. | 128/864 |
| 6,039,685 | * | 3/2000 | Bushek | 439/905 |

* cited by examiner

*Primary Examiner*—Khiem Nguyen
(74) *Attorney, Agent, or Firm*—Lyon & Lyon LLP

(57) ABSTRACT

A device for coupling a programming connector to a programmable hearing aid comprises an electrode coupled to a corresponding conductor of the programming connector, wherein the electrode is biased to maintain contact with a conductive surface in the hearing aid. The coupling device is adapted to engage within a receiver module of a CIC hearing device. Data from an outside source, such as a computer, can thereby be easily transferred through the programming connector to circuitry within the hearing device.

9 Claims, 5 Drawing Sheets

PROGRAMMING CONNECTOR FOR HEARING DEVICES

FIELD OF THE INVENTION

The present invention pertains to hearing devices. More particularly, the present invention pertains to programming connectors for hearing devices.

BACKGROUND OF THE INVENTION

The modern trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices which are cosmetically less visible are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Three main types of In-The-Canal hearing devices are routinely offered by audiologists and physicians. In-The-Ear (ITE) devices rest primarily in the concha of the ear and have the disadvantages of being fairly conspicuous to a bystander and relatively bulky and uncomfortable to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages these types of in-the-canal devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of occlusion effects and improves overall sound fidelity.

While the performance of CIC hearing devices is generally superior to other larger and less sophisticated devices, several challenges remain. When viewed in the transverse plane, the path of the ear canal is extremely irregular, having several sharp bends and curves. This shape and structure, or morphology, varies from person to person. Furthermore, the range and extent of hearing loss typically varies from person to person. A healthy adult ear can sense frequencies between 20 and 20,000 Hz. The same ear can process a sound with an intensity just above 0 dB (a barely audible sound), to a sound intensity over 120 dB. The threshold of pain is 130 dB. Some individuals may only have hearing loss at a certain frequency range and/or within a limited range of sound intensity.

To address the foregoing problems, hearing device manufacturers and audiologists have typically employed programmable hearing devices. In general, programmable hearing devices contain an integrated circuit that maintains customized programs for an individual and/or for a particular sound environment. For instance, the program could direct the hearing device to only amplify sounds at lower frequencies. Alternatively, the program could direct the hearing device to amplify sound frequencies that are only encountered in a specific setting, such as a dinner conversation or a crowded room. Since the range of an individual's hearing loss may change over time, the hearing device program may need to be altered. In order to accommodate these changes, the integrated circuit must be reprogrammed. Reprogramming the integrated circuit is generally performed by using a programming connector that links a programming source (e.g., a computer) with the hearing device circuit. Because an individual's hearing ability may change frequently, or the individual may often move from one sound environment to another, it is desirable that the programming connector allow the integrated circuit to be reprogrammed easily and reliably.

Although known hearing devices employ programming technology, they are not in line with the objectives of component miniaturization. Programmable hearing devices require additional components, such as connection pads, and internal circuitry. These additional components necessarily increase the size of the hearing device. In order to balance the competing objectives of programmability and miniaturization, it is necessary to limit the number and size of the programming components included in the hearing device.

U.S. Pat. No. 4,961,230, entitled "Hearing Aid Programming Interface" ("the '230 patent"), discloses a programming connector that connects an external programming source with internal hearing device circuitry. By fitting inside the battery compartment of a programmable hearing device, the programming connector of the '230 patent obviates the need of a separate port on the hearing device for the programming circuitry. However, the device of the '230 patent still presents problems because it does not provide a structure that allows the electrodes to move independently from the body of the programming connector or independently from one another. Thus, the device of the '230 patent does not provide a consistent or reliable connection between the programming connector, and the internal circuitry of the hearing device.

SUMMARY OF THE INVENTION

The present invention solves the foregoing problems by providing a coupling device that allows electronic data to be programmed into a hearing device. In a first aspect of the invention, a device for coupling a programming connector to a hearing aid comprises an electrode coupled to a corresponding conductor of the programming connector, wherein the electrode is biased to maintain contact with a conductive surface in the hearing aid.

In another aspect of the present invention, a device for coupling a programming connector to a programmable hearing aid comprises a plurality of electrodes, each electrode coupled to a corresponding conductor of the programming connector, wherein the plurality of electrodes are individually biased to maintain contact with a conductive surface in the hearing aid.

In yet another aspect of the present invention, a programming connector for a hearing aid, comprises a handle, an extension member having a proximal end and a distal end, the proximal end of the extension member connected to the handle, a coupling device connected to the distal end of the extender, and, an electrode, wherein the electrode is housed within the coupling device and is biased so that it will maintain contact with a conductive surface in a hearing aid.

Other and further aspects and advantages of the present invention will become apparent hereinafter.

BRIEF DESCRIPTION OF THE DRAWINGS

The drawings illustrate both the design and utility of the preferred embodiments of the present invention, in which similar elements in different embodiments are referred to by the same reference numbers for purposes of ease in illustration of the invention, wherein.

DETAILED DESCRIPTION OF THE PREFERRED EMBODIMENTS

Figure 1:
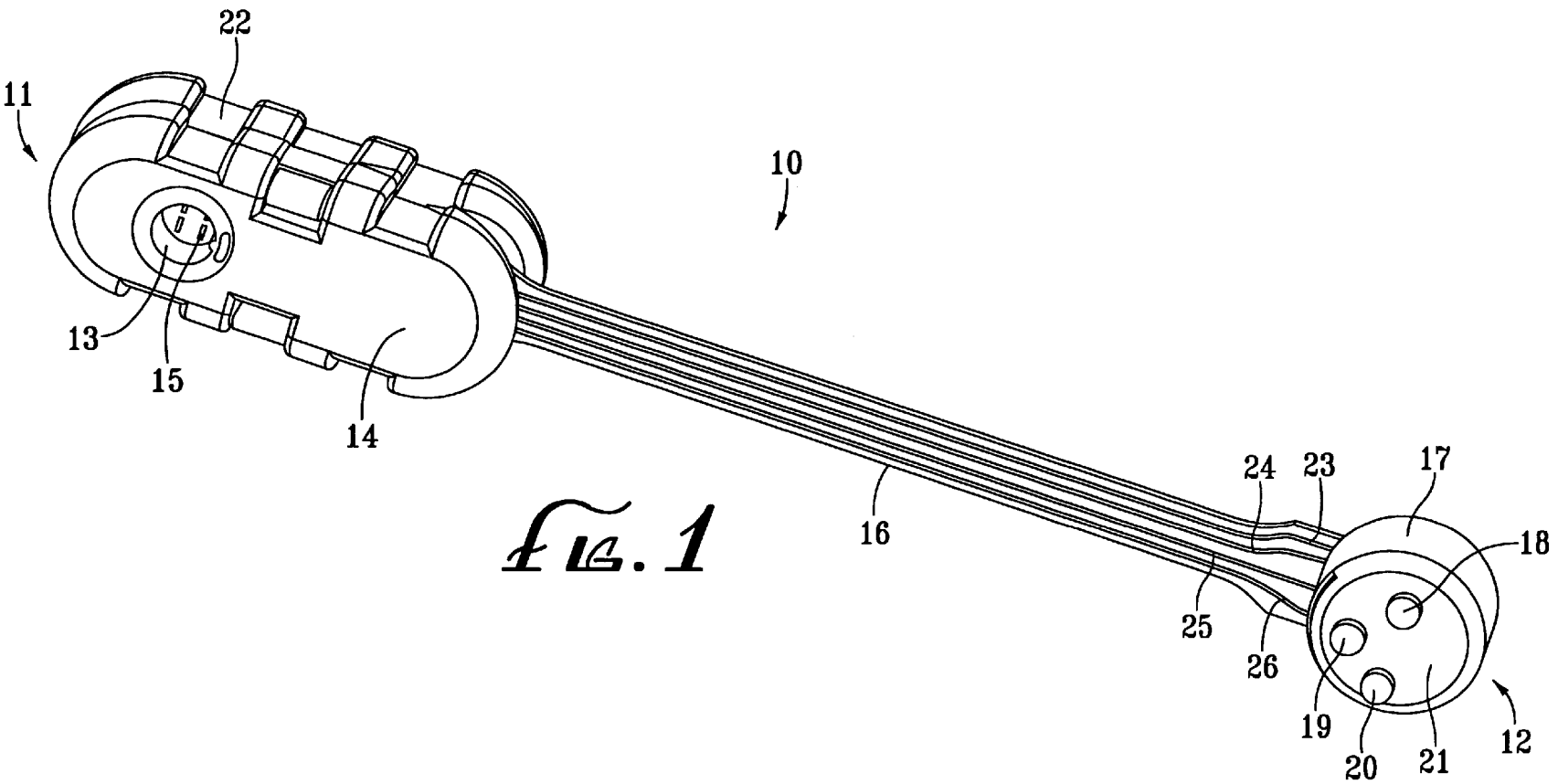
FIG. 1 is a perspective view of a programming connector constructed in accordance with the present invention.
Figure 2:
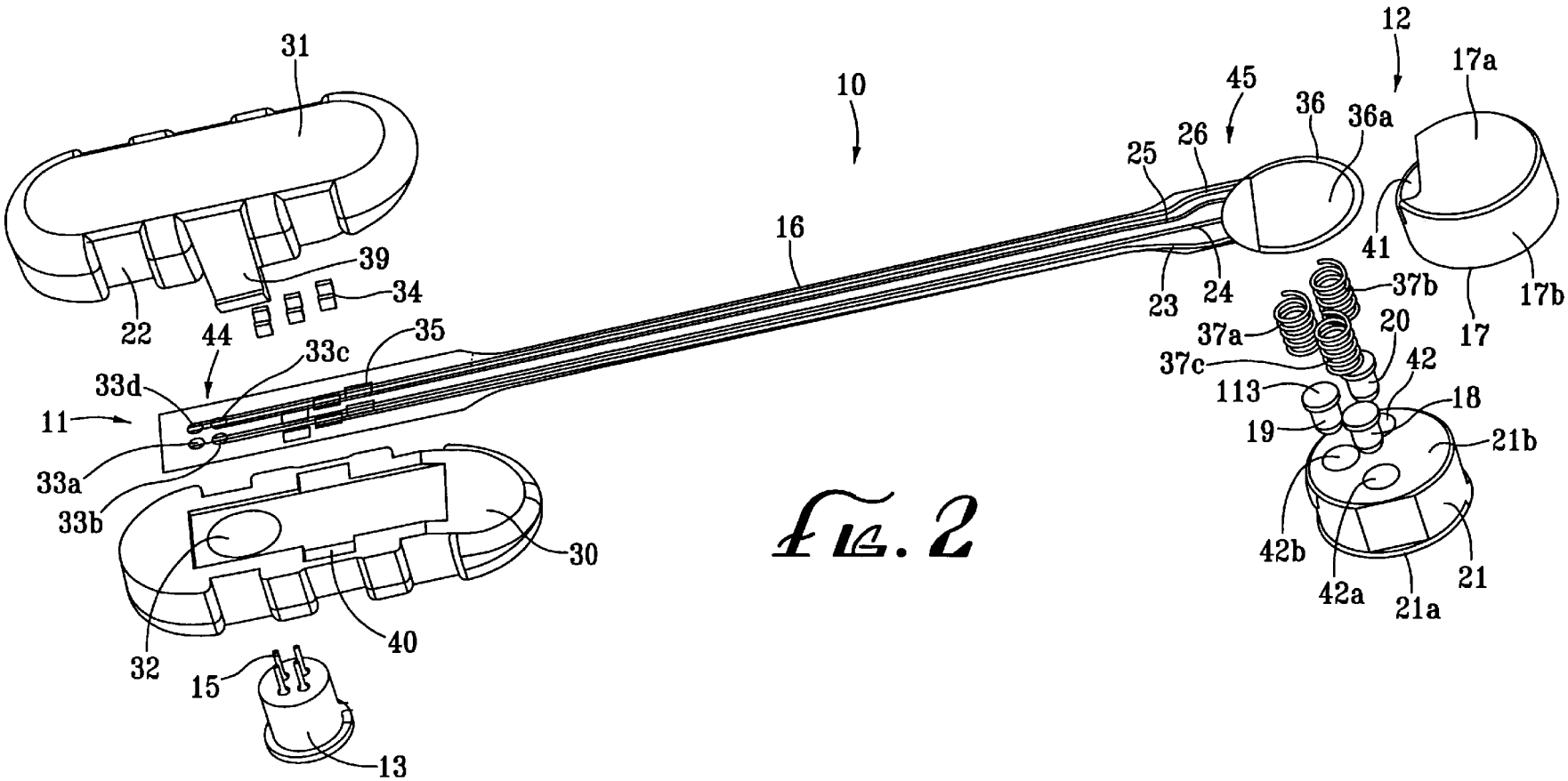
FIG. 2 is an exploded perspective view of the programming connector of FIG. 1.

Referring to FIGS. 1–5B, a programming connector 10 constructed in accordance with the present invention, has a proximal end 11, and a distal end 12. Located on the proximal end 11 of the programming connector 10 is a socket connector 13 incorporated into a handle 14. The socket connector 13 is adapted to allow the programming connector 10 to communicate with an external circuit, such as a computer or another electronic device. Preferably, the socket connector 13 is an industry standard socket connector such as a CS44 socket connector.

The handle 14 is connected to an extension member 16. The extension member 16 is preferably a flexible, planar substrate made from a material such as Mylar™, but may alternately have a tubular, rectangular, or oblong shape. Various other shapes of the extension member 16 are also contemplated by the present invention. The extension member 16 may alternately be formed from a rigid material.

Figure 3A:
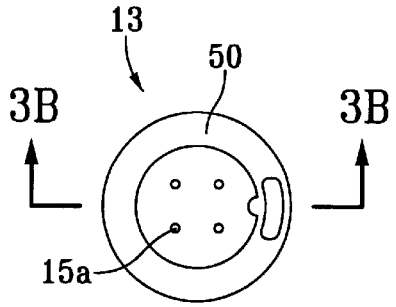
FIGS. 3A–3C are various views of a programming connector socket connector.
Figure 3B:
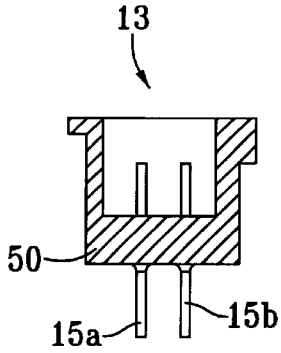
Figure 3C:
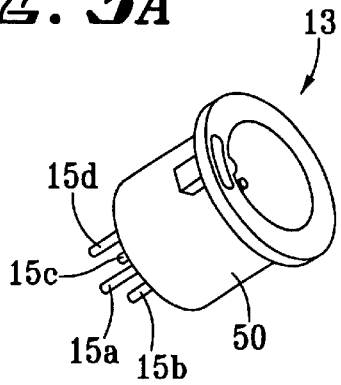
Figure 4:
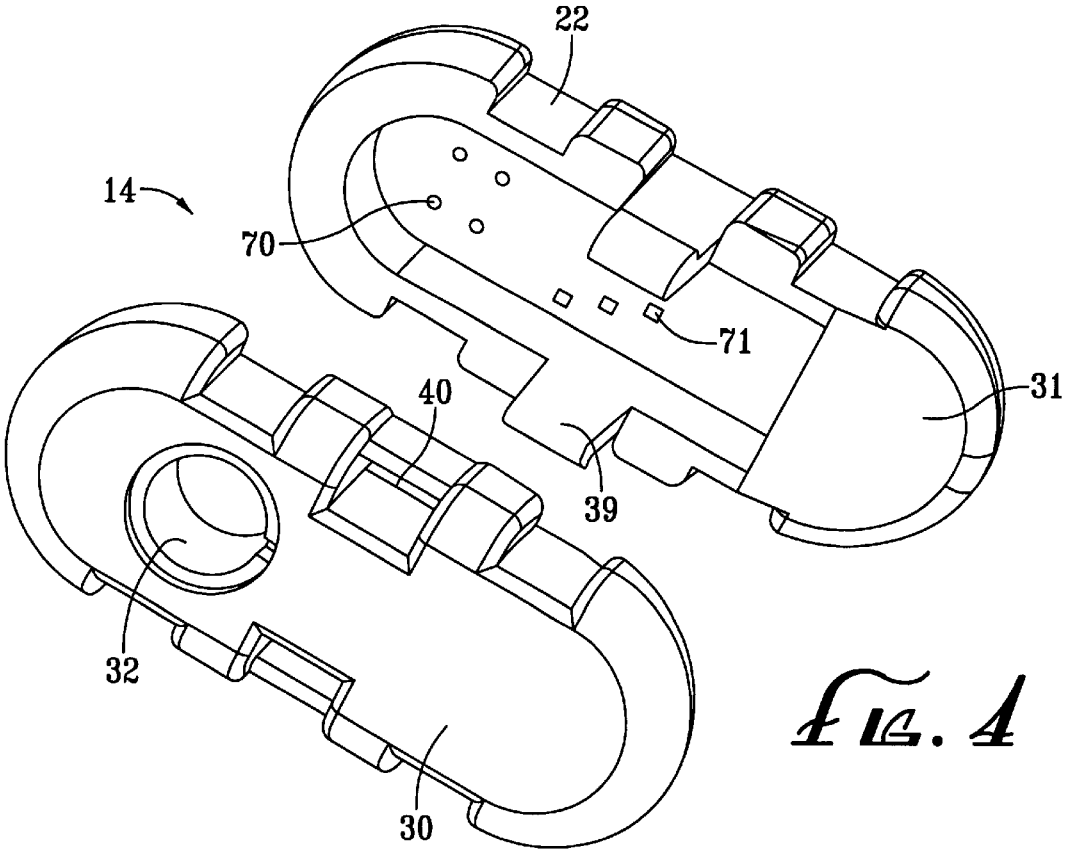
FIG. 4 is an exploded perspective view of a programming connector handle.

The handle 14, provides electrical insulation, and a convenient area to grasp the programming connector 10. The handle 14 preferably includes tactile ridges 22 along its periphery, that further facilitate grasping the programming connector 10. The handle 14 includes a first handle portion 30, and a second handle portion 31. The first handle portion 30 includes an aperture 32 which is adapted to receive the socket connector 13. As best shown in FIGS. 3A–3C, the socket connector 13 includes four socket pins 15*a*, 15*b*,15*c*, and 15*d*. The first and second handle portions 30 and 31 are assembled and connected by inserting a tab 39 on the second handle portion 31 into a slot 40 on the first handle portion 30. The second handle portion 31 also preferably includes recesses 70 that receive and provide mechanical support for the socket pins 15*a*–15*d*, as well as recesses 71 that provide a mounting location for capacitors 34 (Best seen in FIG. 4).

The socket connector 13 is formed from a plastic casing 50 and has the pins 15*a*–15*d* extend from the casing 50. The socket connector 13 is inserted through the aperture 32 on the handle 14, such that each of the socket pins 15*a*–15*d* engage with a corresponding connector ring 33*a*–33*d* located on a proximal end 44 of the extension member 16. The socket pins 15*a*–15*d* are held in place in the connection rings 33*a*–33*d* either by friction alone or by the use of an industry standard adhesive such as adhesives sold by Loctite™. By engaging with the connector rings 33*a*–33*d*, each of the socket pins 15*a*–15*d* are in electrical communication with the connector rings 33*a*–33*d*.

Also located on the proximal end 44 of the extension member 16 are capacitors 34, each mounted to a capacitor pad 35. Preferably the capacitors are etched copper pads. The capacitors are decoupling capacitors well known in the field of circuit design.

The extension member 16 includes four electrically conductive pathways, a positive pathway 23, a ground pathway 24, a data pathway 25, and a clock pathway 26. Each of the electrically conductive pathways 23, 24, 25, and 26 can either be embedded in the extension member 16, or can be deposited on its surface. Preferably, the electrically conductive pathways are electrical traces etched into the extension member 16. The electrical pathways 23, 24, 25, and 26 are in electrical communication with the connection rings 33*a*–33*d*, respectively. Since the connection rings 33*a*–33*d* are in electrical communication with the socket pins 15*a*–15*d*, an electrical path is maintained between the electrical pathways 23, 24, 25, and the socket pins 15*a*–15*d*.

The distal end 12 of the programming connector 10 includes a coupler 21 that provides a support structure for four electrodes. The coupler is shaped so that it will engage with a hearing device receiver module (Described in FIGS. 6 and 7). A positive electrode 17 includes a top surface 17*a* and a circumferential surface 17*b* so that the positive electrode 17 forms a substantially cup-shaped element that fits over the coupler 21. The positive electrode 17 is preferably made from brass. The coupler 21 has a first surface 21*a*, a second surface 21*b*, and three chambers 42*a*, 42*b*, and 42*c* extending from the first surface to the second surface.

Figure 5A:
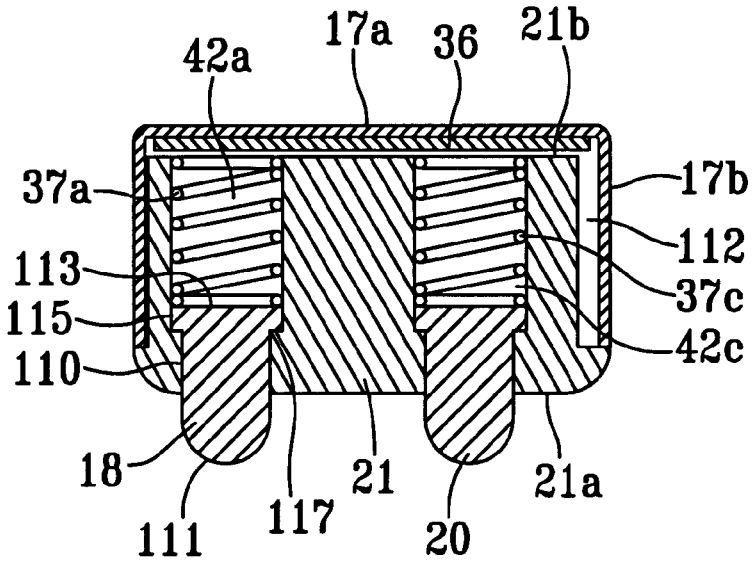
FIGS. 5A and 5B are cross-sectional views of a programming connector coupler.
Figure 5B:
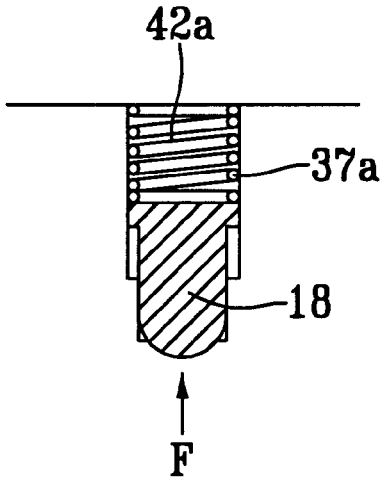

Mounted in each of the chambers 42*a*, 42*b*, and 42*c* is a pin electrode. As shown in FIG. 5A, a ground pin electrode 18 is mounted in chamber 42*a* and a clock pin electrode 20 is mounted in chamber 42*c*. Similarly, as shown in FIG. 5B, a data pin electrode 19 is mounted in chamber 42*b*. Each of the pin electrodes 18, 19, and 20 are electrically conductive and preferably have a nickel-gold coating. Each of the electrodes 18, 19, and 20 are in electrical communication with a biasing member 37*a*, 37*b*, and 37*c*, respectively. The biasing members 37*a*, 37*b*, and 37*c* are also housed within the chambers 42*a*, 42*b*, and 42*c*. As best seen in FIGS. 5A and 5B, the biasing members rest on a flanged surface 113 of each of the pin electrodes 18, 19, and 20.

Located at a distal end 45 of the extension member 16 is a disk shaped positive contact pad 36. A top surface 36*a* of the positive contact pad 36 is in electrical communication with the positive electrical pathway 23. The positive electrode 17 has a slot 41 that is adapted to receive the distal end 45 of the extension member 16, and more particularly the positive contact pad 36. When inserted through the slot 41, the top surface 36*a* of the positive contact pad 36 engages with the top surface 17*a* of the positive electrode 17 (Best seen in FIGS. 2 and 5A). A bottom surface 36*b* of the positive contact pad includes extensions of the conductive pathways 24, 25, and 26 thereon, so that when the positive contact pad 36 is inserted through the slot 41 of the positive electrode 17, and the coupler 21 is engaged with the positive electrode 17, the bottom surface 36*b* of the positive contact pad 36 will contact the biasing members 37*a*, 37*b*, and 37*c* that are housed in the chambers 42*a*, 42*b*, and 42*c*. The conductive pathways 24, 25, and 26 that extend along the bottom surface 36*b* of the positive contact pad 36 are routed across the positive contact pad so that they will contact the biasing members 37*a*, 37*b*, and 37*c*, respectively. The positive contact pad 36 also serves as a cover that holds the biasing members 37*a*, 37*b*, and 37*c* within each of the chambers in the coupler 21. A solder paste 112 is preferably used to secure the coupler 21 to the positive contact pad 36 and the positive electrode 17.

Since the pin electrodes 18, 19, and 20 are in electrical communication with the biasing members 37*a*–37*c*, which are in turn in electrical communication with the conductive pathways 24, 25, and 26, a continuous electrical pathway is maintained between the pin electrodes 18, 19, and 20 and the connector pins 15*b*–15*d* on the socket connector 13. Likewise a continuous electrical pathway is maintained between the positive electrode 17 and the connector pin 15*a* on the socket connector 13.

The ground pin electrode 18, the data pin electrode 19, and the clock pin electrode 20 are mounted to the biasing members 37*a*–37*c* such that each of the electrodes 18, 19, and 20 can move in a direction normal to the biasing members, independent from the movement of the other electrodes, and independent of any movement of the coupler 21.

The biasing members 37*a*–37*c* are formed from a resilient or elastic material such as compressed rubber, or steel. In a preferred embodiment, the biasing members 37*a*–37*c* are made of a resilient alloy, such as a stainless steel or a copper alloy, and are formed into springs. The resiliency of the biasing members applies a continuous force on the electrodes 18, 19, and 20 and allows them to be maintained in a fully extended position until an opposing force is applied.

Flanges 115 on each of the electrodes, and a seat 117 within each of the chambers 42*a*–42*c*, limit the distance the electrodes can extend from the coupler 21. When an external force F is applied to a contact surface 111 of each of the electrodes 18, 19, and 20, they will move in a direction normal to the biasing members 37*a*–37*c* (i.e. in a direction in line with the movement of the biasing members 37*a*–37*c*, and along a longitudinal axis of the chambers), and will retract slightly into the coupler 21. (Best seen in FIG. 5B) Upon releasing the force F from each of the electrodes, the electrode will return to its fully extended position.

In an alternate embodiment, each of the electrodes 18, 19, and 20 can also move in a plane perpendicular to the biasing members 37*a*–37*c*. Thus, the electrodes 18, 19, and 20, may experience three degrees of freedom in relation to the biasing members 37*a*–37*c*. For instance, each of the electrodes 18, 19, and 20 may be flexibly attached (e.g., by way of a hinge) to the biasing members 37*a*–37*c*.

Figure 6:
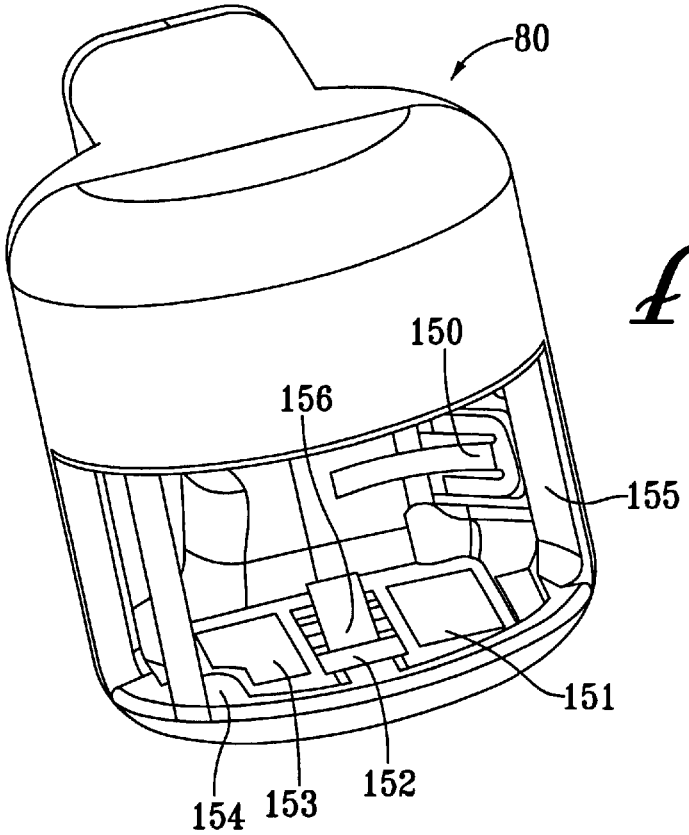
FIG. 6 is a front perspective view of a hearing device receiver module.
Figure 7:
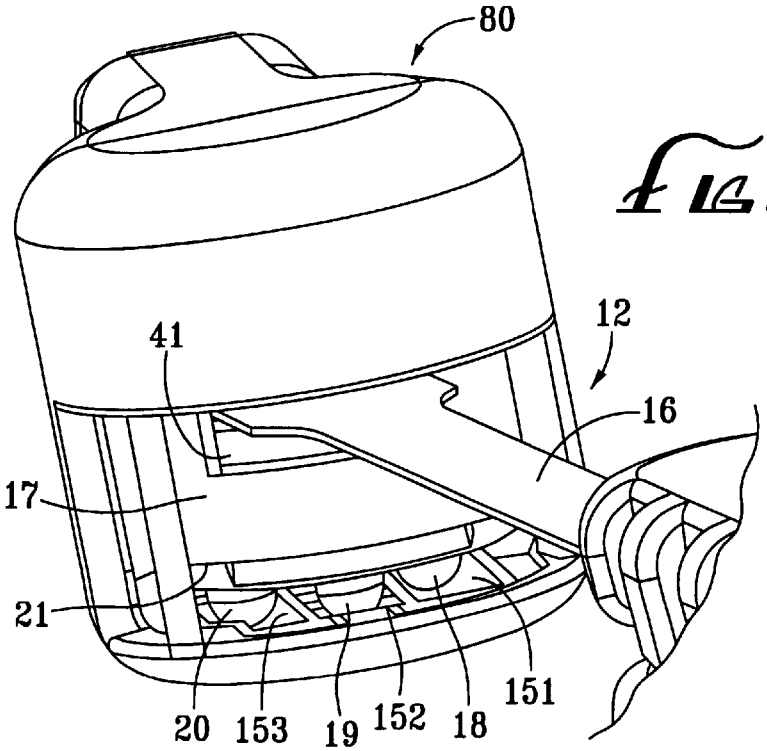
FIG. 7 is a perspective view of the receiver module of FIG. 6 engaged with a programming connector constructed in accordance with the present invention.

A programming connector constructed in accordance with the present invention is preferably used in conjunction with a CIC hearing device. FIGS. 6 and 7 show a preferred embodiment of a receiver module 80 of such a hearing device. U.S. patent application Ser. No. 09/467,102, filed on the same date as the present application, disclose and teach preferred embodiments of such a receiver module, the details of which are hereby fully incorporated by reference into the present application. In FIG. 6, the receiver module 80 defines a chamber 155 that houses, among other elements, a hearing device battery (not shown), and a circuit board assembly 154. Preferably, the circuit board assembly 154 includes a positive battery contact 150, a ground connection pad 151, a data connection pad 152, a clock connection pad 153, and a negative battery contact 156.

Since the circuit board assembly 154 is formed in a separate manufacturing process, its surface is not always completely flat and may vary from device to device. Surface variations may also be present in the individual contact pads within the receiver module. Surface variations may result from a manufacturing defect, or from degradation of the material used for the circuit board assembly 154 (e.g., cracking due to thermal expansion). Additionally, the design of the circuit board assembly 154 may require that the respective contact pads be formed on different planes.

FIG. 7 illustrates how the programming connector 10, and particularly the coupler 21 engages within the receiver module 80, and how each of the electrodes on the programming connector engages with a respective contact pad in the receiver module. When inserted into the chamber 155, each of the electrodes 18, 19, and 20, contact the corresponding connection pads 151, 152, and 153. The ground pin electrode 18 contacts the ground connection pad 151, the data pin electrode 19 contacts the data connection pad 152, and the clock pin electrode 20 contacts the clock connection pad 153. Similarly, the positive electrode 17 contacts the positive battery contact 150. When inserted into the receiver module, each of the mounting members 37*a*–37*c* exert a force so that each of the pin connector electrodes, 18, 19, and 20, securely engages with the connection pads 151, 152, and 153, respectively. Due to the biasing of each of the electrodes 18, 19, and 20, each electrode maintains a continuous force on the respective contact pad and thus maintains continuous contact with the pad. In this manner, a consistent and reliable electrical connection is maintained regardless of whether there are surface variations on the circuit board assembly 154, whether the contact pads are in different planes, or whether the programming connector 10 is moved or otherwise disturbed during programming of the hearing device.

Although the invention has been described and illustrated in the above description and drawings, it is understood that this description is by example only and that numerous changes and modifications can be made by those skilled in the art without departing from the true spirit and scope of the invention. The invention, therefore, is not to be restricted, except by the following claims and their equivalents.

What is claimed is:

1. A coupling device for coupling a programming connector to a programmable hearing aid, the programming connector carrying one or more conductors, the coupling device located proximate a distal end of the programming connector, the coupling device comprising:

an electrode coupled to a corresponding conductor of the programming connector, wherein the electrode is biased to maintain contact with a conductive surface in the hearing aid;

a first surface, a second surface, and a chamber, the chamber extending from the first surface to the second surface, wherein the electrode is mounted within the chamber such that a first end of the electrode extends beyond the first surface of the coupling device; and a biasing member mounted to a second end of the electrode and within the chamber;

wherein the distal end of the programming connector is attached to the second surface of the coupler such that the distal end of the programming connector retains the biasing member and the electrode within the chamber.

2. The coupling device of claim 1, further comprising a handle connected to a proximal end of the programming connector.

3. The coupling device of claim 2, further comprising tactile ridges disposed on a periphery of the handle.

4. The coupling device of claim 2, further comprising a socket connector on the handle in communication with the conductor on the programming connector such that a conductive pathway is maintained from the socket connector to the electrode.

5. The coupling device of claim 1, wherein the first end of the electrode is flanged, and the second end of the electrode is rounded.

6. The coupling device of claim 1, wherein the biasing member is a spring.

7. The coupling device of claim 1, wherein the biasing member is elastic.

8. The coupling device of claim 4, wherein electronic data can be transferred from the socket connector to the electrode.

9. The coupling device of claim 1, wherein applying a force to the second end of the electrode causes the electrode to retract into the chamber, and wherein releasing the force causes the electrode to return to a fully extended position.

* * * * *